United States Patent [19]

Kelly

[11] 4,362,421

[45] Dec. 7, 1982

[54] ANCHOR FOR USE IN THE POST-TENSIONING OF PRESTRESSED CONCRETE

[76] Inventor: William F. Kelly, 100 Bellaire Dr., New Orleans, La. 70124

[21] Appl. No.: 331,384

[22] Filed: Dec. 16, 1981

Related U.S. Application Data

[63] Continuation of Ser. No. 130,599, Mar. 17, 1980, abandoned.

[51] Int. Cl.[3] ..... B25G 3/20; F16B 2/00; F16B 7/04

[52] U.S. Cl. ..... 403/369; 52/223 L; 403/374; 249/190; 425/111; 264/228

[58] Field of Search ..... 403/369, 374, 409; 52/223 R, 223 L, 230; 249/190, 217; 425/111; 264/228, 229

[56] References Cited

U.S. PATENT DOCUMENTS

| | | | |
|---|---|---|---|
| 2,858,758 | 11/1958 | Carter | 403/355 X |
| 3,676,034 | 7/1972 | Stinton et al. | 425/111 |
| 3,762,027 | 10/1973 | Burtelson | 52/223 L |
| 3,766,609 | 10/1973 | Brandestini et al. | 425/111 X |
| 3,833,706 | 9/1974 | Edwards | 52/230 X |
| 3,877,113 | 4/1975 | Reyes | 403/374 X |
| 3,952,377 | 4/1976 | Morell | 403/374 X |

FOREIGN PATENT DOCUMENTS

| | | | |
|---|---|---|---|
| 99869 | 4/1962 | Norway | 52/230 |

*Primary Examiner*—Wayne L. Shedd
*Attorney, Agent, or Firm*—Shlesinger, Arkwright, Garvey & Dinsmore

[57] ABSTRACT

An anchor for use in the post-tensioning of prestressed concrete, including an anchor case having a longitudinally tapering outer wall surface and a tapered longitudinal bore for receiving a chuck comprising wedge segments which are in gripping engagement with a tendon passing therebetween. The anchor case and chuck are approximately the same length, and the anchor case is cold forged with the top end thereof folded inwardly to effect greater thickness at that point, which structure, in combination with a dome-shape thrust plate extending outwardly from the outer periphery of the anchor case proximate the folded portion thereof, contains the hoop forces exerted on the anchor case by the chuck.

9 Claims, 14 Drawing Figures

ANCHOR FOR USE IN THE POST-TENSIONING OF PRESTRESSED CONCRETE

This application is a continuation of application Ser. No. 130,599, filed Mar. 17, 1980 now abandoned.

BACKGROUND OF THE INVENTION

The anchor of the present invention is an improvement on the anchor device of my previously granted U.S. Pat. Nos. 3,524,228 and Reissue 27,954.

In these patents, there is disclosed an anchor for post-tensioning of prestressed concrete which includes an elongated tapering anchor case in which is movably positioned a chuck having a longitudinally tapering outer wall and comprising a plurality of wedge segments for grippingly engaging a tendon passing therethrough. In its present commercial form, the anchor case is 4.35 inches long after forming, and the chuck is 2 inches long. The anchor case includes a relatively straight, tubular, bore portion extending from the large end thereof to a point intermediate the length of the anchor case, which portion, when the anchor serves as a dead end anchor, is adapted to receive a spring and closure cap.

The angularity of the tapering anchor case bore is then altered through a substantial part of the anchor case to provide a working taper which is engaged by the outer periphery of the tapering chuck. As the tendon is jacked through the anchor, the chuck engages the tendon with progressively increased force. In order to relieve the gripping forces exerted on the tendon by the leading part of the chuck, the angularity of the anchor case taper is decreased, thereby reducing the force being exerted on the tendon at that point, with the result that the gripping force exerted by the chuck wedge segments are exerted more proportionately over a greater length of the tendon.

The anchors of the aforementioned patents further include a rolled edge at the large end of the case and a reaction plate which is engaged with the case periphery adjacent the rolled edge. A secondary reaction plate is engaged with the case periphery at a point intermediate its length and serves as a restraining element to counteract the hoop stress built up in the inside of the case by the transverse pressure of the chuck wedge segments.

In manufacture of the above anchor, the anchor case is forged, heat treated, the primary reaction plate (not heat treated) installed and the secondary reaction plate (not heat treated) installed, a total of four operations. Various sizes of this anchor are made in order to accommodate different sizes of cables such as $\frac{3}{8}$ inch, 7/16 inch, $\frac{1}{2}$inch, etc.

SUMMARY OF THE INVENTION

The present invention is an anchor for use in the post-tensioning of prestressed concrete which anchor, although performing the same function as the anchor set out in U.S. Pat. Nos. 3,524,228 and Reissue 27,954, requires substantially less material, involves fewer manufacturing steps, and consequently is more economical to manufacture.

In order to achieve the objectives of the present invention, the anchor includes an anchor case which is less than half the length of my prior anchor case and, accordingly, requires proportionately less material for manufacture. The upper end of the case is folded inwardly in order to effect greater depth of thickness of case metal and to increase the effective length of the case to hold the hoop forces generated by the chuck wedge segments outward thrust. Additionally, a thrust plate of dome-shape extends outwardly from the periphery of the case for counteracting the forces exerted thereon by the chuck wedge segments. The chuck wedge segments are approximately the same length as the anchor case, and the bore of the case has incorporated therein a double working taper, whereby relief is afforded to that portion of the tendon passing through the narrow end of the anchor case, so that the gripping forces exerted on the periphery of the tendon by the chuck wedge segments are relieved at that point and more proportionately distributed over a greater length of the tendon within the anchor chuck.

The present anchor requires a minimum of metal, substantially less than previously used, and the anchor is short-coupled and can fit in any close quarter. The case of the anchor is forged steel, and is able to withstand and restrain the stresses exerted thereon by the chuck working therein.

Since the case is a forging, it can also be gauged accurately to determine stress left on the tendon as the tension is directly related to the seated depth of the chuck. Such a determination cannot be made with cast anchors.

DETAILED DESCRIPTION OF THE INVENTION

Figure 2:
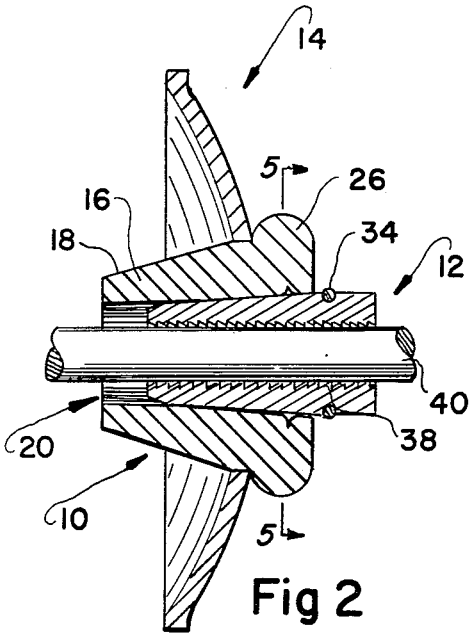
FIG. 2 is a longitudinal sectional view of the present anchor showing the chuck wedge segments in operative position.

Referring now in greater detail to the drawings, the anchor of the present invention generally includes an anchor case 10, a chuck 12 operable within anchor case 10, and a thrust plate 14 extending outwardly from the outer periphery of anchor case 10.

Anchor case 10 includes a tubular member 16 having a tapering outer wall surface 18 which intersects a right circular cylindrical portion 19 at a point intermediate the length of the case. A longitudinal bore extends through anchor case 10, as indicated at 20. The inner wall of anchor case 10, defining longitudinal bore 20, is tapered inwardly from the large end of the anchor case to a point intermediate the length thereof, to provide a working taper 22, the taper being reduced from that point to the small end of the anchor case, to provide a relief taper 24.

Anchor case 10 is preferably cold forged and coined to size from a 2 inch piece of tubular cold rolled steel, mechanical electrical welding tubing, having an outer diameter of 1-3/16 inches, and a wall thickness of 3/16 inches. In the forging process, the upper end of the tubular steel member is folded inwardly to provide a thickened wall portion 26, the inner extreme of which defines the upper end of longitudinal bore 20. The folding process forms a slight annular indentation 27 in that portion of the wall of the anchor case which defines longitudinal bore 20. This inwardly folded portion causes the stress forces exerted by the chuck in the anchor case to be directed longitudinally of the outside of the anchor case to thickened wall portion 26 and then downwardly inside of the anchor case. This minimizes the danger of tearing the anchor case under the stresses produced in the post-tensioning operation.

Figure 4:
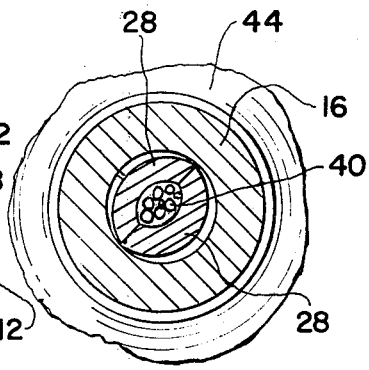
FIG. 4 is a sectional view taken along the line 4—4 of FIG. 1 looking in the direction of the arrows.
Figure 9:
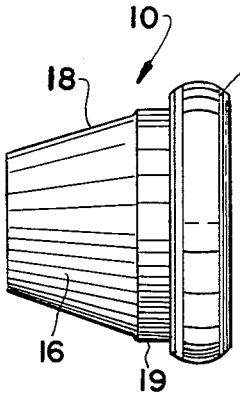
FIG. 9 is a side elevational view of an anchor case forming a part of the present invention.
Figure 12:
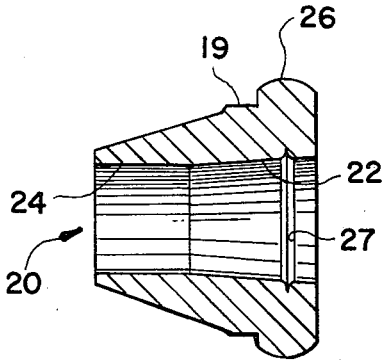
FIG. 12 is a longitudinal sectional view of the anchor case.
Figure 10:
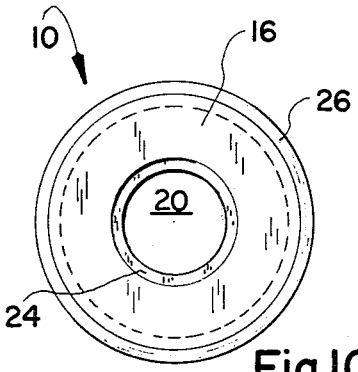
FIG. 10 is an end elevational view of the anchor case as viewed from the small end thereof.
Figure 11:
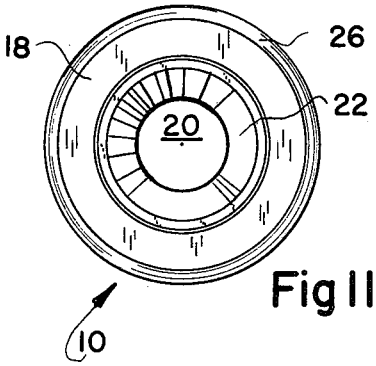
FIG. 11 is an end elevational view of the anchor case as viewed from the large end thereof.
Figure 13:
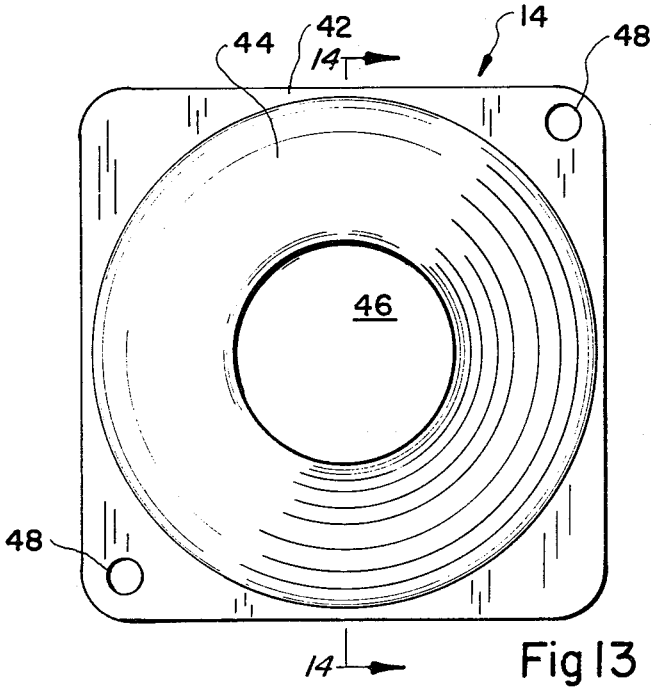
FIG. 13 is an elevational view of a thrust plate forming a part of the present invention.
Figure 14:
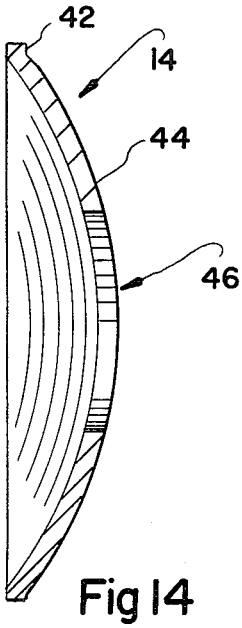
FIG. 14 is a sectional view taken along the line 14—14 of FIG. 13, looking in the direction of the arrows.

Chuck 12 is positioned within longitudinal bore 20 of tubular member 16 and, as shown to advantage in FIGS. 1 to 8, includes a pair of wedge segments 28 which are preferably of cold forged ductile, surface hardened steel which is heat treated, the segments being of semi-elliptical shaped cross section prior to jacking through the anchor case as shown in FIG. 4. The outer walls of wedge segments 28 are longitudinally tapered at 30 for engagement with the tapered inner wall surface of anchor case 10. Wedge segments 28 are provided with aligned peripheral recesses 32 for receiving a spring member 34 for holding the wedge segments in opposed facing relationship. The interior wall of each wedge segment is of an arcuate conformation and provided with a series of teeth 38 for grippingly engaging a tendon 40 passing between the segments. Different wedge segments 28 may be selectively used with $\frac{3}{8}$ inch, 7/16 inch or $\frac{1}{2}$ inch tendon, which segments may be interchangeably employed with the same anchor case 10.

It has been found that optimum results are obtained with wedge segments having a 4° angularity working in an anchor case having a working taper of $4\frac{1}{2}$°, and wherein the relief taper is 4°.

Figure 1:
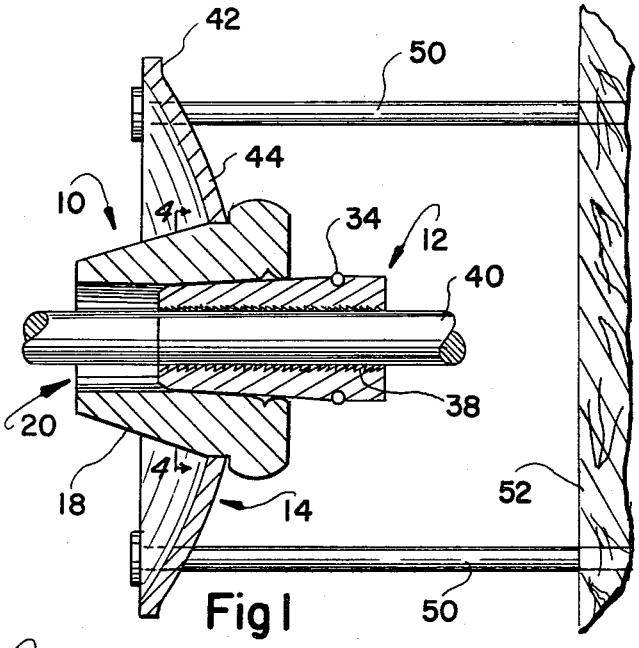
FIG. 1 is a longitudinal view of the anchor of the present invention illustrating its use, and showing the chuck wedge segments in inoperative position.
Figure 3:
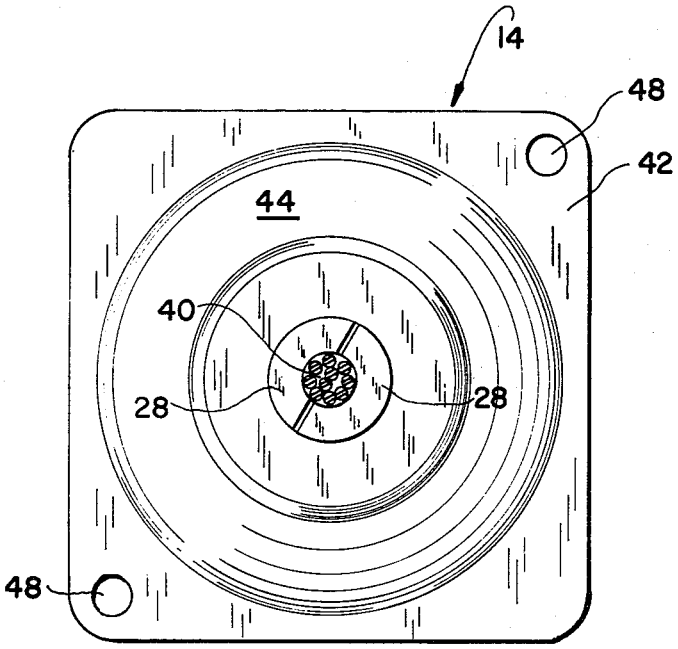
FIG. 3 is a rear elevational view of the present anchor.
Figure 5:
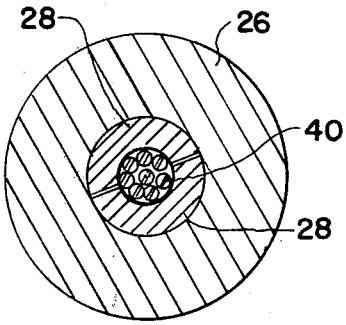
FIG. 5 is a sectional view taken along the line 5—5 of FIG. 2.
Figure 6:
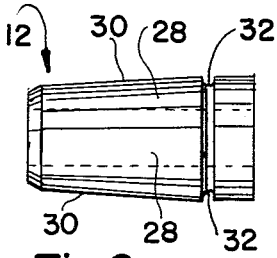
FIG. 6 is a side elevational view of the chuck of the present assembly.
Figure 7:
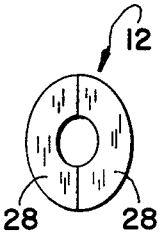
FIG. 7 is an end view of the chuck of FIG. 6 taken from the large end thereof.
Figure 8:
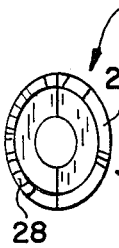
FIG. 8 is an end view of the chuck of FIG. 6 taken from the same end thereof.

Thrust plate 14 is illustrated to advantage in FIGS. 1 to 3 and 13, 14, and preferably comprises 3/16 inch thick by $3\frac{1}{2}$ inch square, mild carbon steel plate 42 which is hot rolled and stamped in a multistage die so that the major portion thereof assumes a dome-shape, as indicated at 44, to effect increased strength. The dome-shape plate is approximately $\frac{7}{8}$ of an inch in height and has a central opening 46 for fitting the thrust plate on flattened portion 19 of the anchor case under application of approximately 30 tons pressure. This locates the thrust plate proximate the thickened portion of the anchor case and at the point of maximum hoop stress on anchor case 10. Nail openings are provided in thrust plate 14 as indicated at 48 through which nails 50 pass for securing the anchor to a form 52, as shown in FIG. 1.

Since the anchor case of the present invention is cold forged by a die and impacted hard enough to result in coining, all anchor cases are alike. Therefore, since the tension on the jacked tendon is directly related to the depth of penetration of the chuck into the anchor case, the tension on the tendon may be readily determined by means of a simple gauge which measures the length of the portion of the chuck protruding from the anchor case.

OPERATION

In use of the device of the present invention, one anchor is secured to form 52 as shown in FIG. 1, which anchor serves as a dead end anchor. A second anchor is secured to a second form in opposed relation to the first anchor for use as a live end anchor, in accordance with conventional practice.

Upon jacking of tendon 34 through the live end anchor, by exertion of a predetermined force thereon in a direction away from the dead end anchor, the wedge segments 28 of the dead end anchor are forced inwardly of anchor case 16, at which time the wedge segments are forced into gripping engagement with tendon 34. The outer walls of the segments engage working taper 22 and a portion of relief taper 24, and the shape of the wedge segments is conformed to that of the circular wall defining the anchor case bore, the relief taper serving to distribute the forces exerted over a larger area of the wedge segment and tendon. This reduces the tendency for the wedges to nick the tendon when it is pulled therethrough, thereby preventing reduction in the tendon's strength.

By virtue of the structural arrangement and relationship of the component parts of the anchor, an anchor of superior strength is provided, which anchor requires considerable less steel than anchors heretofore used. In this connection, the inwardly folded portion 26 of anchor case 16 terminates at the wedge line of the case to effectively increase the depth of the anchor without additional steel consumption. Also, the thickness of the metal at this point contains the hoop stresses generated by the outward thrust of the wedge segments and the reaction plate of dome-shape affords the necessary strength to handle the needs of a $\frac{1}{2}$ inch tendon or a pull in excess of 43,000 pounds to ultimate of the tendon. Since the wedge segments and anchor case are approximately the same length, the bulk of the force exerted on the anchor case occurs in the first three quarters of an inch, and the provision of the thickened portion 26 and reaction plate 14 enables the anchor case to withstand the forces exerted on the case at that point to be met without failure of the anchor case.

The present anchor, therefore, provides a device capable of performing the functions of a conventional anchor of considerably larger size, while at the same time requiring less than half the amount of material for manufacture as compared to the conventional anchor. The anchor case and chuck are approximately $1\frac{1}{2}$ inches in height, are short coupled and adapted to fit any close quarter.

In the manufacture of the present anchor, the anchor case is forged and heat treated and the thrust plate is stamped out, heat treated and installed on the outer periphery of the anchor case, thereby requiring a minimum number of steps to provide the basic components of the anchor. One size of anchor will accommodate different sizes of tendons, such as $\frac{3}{8}$ inch, 7/16 inch and $\frac{1}{2}$ inch, and larger anchors will handle larger tendons.

While there has been herein shown and described the presently preferred form of this invention, it is to be understood that such has been done for purposes of illustration only, and that various changes may be made within the scope of the appended claims.

What is claimed is:

1. A tendon-gripping anchor for use in the post-tensioning of prestressed concrete, including
(a) an anchor case of unitary construction comprising a tubular member having a longitudinal bore
(b) the inner wall surface of said tubular member being tapered from one end to the other
(c) a chuck positioned within the longitudinal bore of said tubular member
(d) said chuck comprising a plurality of transversely arcuate wedge segments
(e) the outer face of said wedge segments being tapered longitudinally for engagement with the tapering inner wall surface of said tubular member
(f) the inner face of each of said wedge segments being provided with a plurality of tendon-gripping members
(g) the wall of said tubular member being thickened at one end of said anchor case
(h) the outer wall surface of said tubular member being tapered from one end thereof to a point intermediate the length thereof
(i) thrust plate receiving means on the outer wall surface of said tubular member, and
(j) a thrust plate having a central opening positioned on said thrust plate receiving means whereby, when said chuck is drawn through said anchor case, hoop stresses exerted by the wedge segments are directed at, and contained by, said thickened wall portion and said thrust plate.

2. The tendon-gripping anchor of claim 1 wherein
(a) said chuck and anchor case are of approximately the same length.

3. The tendon-gripping anchor of claim 1 wherein
(a) said thrust plate is of dome shape.

4. The tendon-gripping anchor of claim 1 wherein
(a) said thrust plate receiving means comprises a right circular portion intersected by the tapering outer wall of said tubular member, said thrust plate being seated on said right circular portion.

5. A tendon-gripping anchor for use in the post-tensioning of prestressed concrete, including
(a) an anchor case of unitary construction comprising a tubular member having a longitudinal bore
(b) the inner wall surface of said tubular member being tapered from one end to the other
(c) the outer wall of said tubular member being tapered from its lower extremity to a point intermediate the length thereof
(d) the upper end of said tubular member having a thickened wall portion comprising a first outwardly extending part and a second inwardly extending part which lies in superimposed contiguous relation with said first part, the inner limit of said second part defining the upper end of the anchor case longitudinal bore
(e) a chuck positioned within the longitudinal bore of said tubular member
(f) said chuck comprising a plurality of transversely arcuate wedge segments
(g) the outer face of each of said wedge segments being tapered longitudinally for engagement with the tapering inner wall of said tubular member
(h) the inner face of said wedge segments being provided with a plurality of tendon-gripping members, and
(i) a thrust plate positioned on the tapering outer wall of said tubular member in proximate relation to said thickened wall portion whereby, when said chuck is drawn through said anchor case, hoop stresses exerted by the wedge segments are directed at, and contained by, said thickened wall portion and thrust plate.

6. The anchor of claim 5 wherein
(a) said chuck and anchor case are of approximately the same length.

7. The anchor of claim 5 wherein
(a) the tapering outer wall of said anchor case intersects a right circular cylindrical portion at a point intermediate the length of the anchor case, and
(b) said thrust plate is of dome shape and has a central opening for fitting the thrust plate on the right circular cylindrical portion.

8. The anchor of claim 5 wherein
(a) the inner wall of said anchor case defining the longitudinal bore is tapered inwardly from the large end of the anchor case to a point intermediate the length thereof, thereby providing a working taper
(b) the angularity of the taper being reduced from a point intermediate the length thereof to the small end of the anchor case to provide a relief taper, whereby the forces exerted by the wedge segments are distributed over a large area of the tendon.

9. The anchor of claim 8 wherein
(a) the working taper of the anchor case bore is approximately $4\frac{1}{2}°$, the relief taper of the anchor case is approximately 4°, and the longitudinal taper of said wedge segments is approximately 4°.

* * * * *